US009580841B2

(12) United States Patent
Stahlecker et al.

(10) Patent No.: US 9,580,841 B2
(45) Date of Patent: Feb. 28, 2017

(54) FALSE TWIST DEVICE FOR AN OPEN-END SPINNING DEVICE

(71) Applicant: Maschinenfabrik Rieter AG, Winterthur (CH)

(72) Inventors: Gerd Stahlecker, Eislingen/Fils (DE); Siegfried Krohmer, Beuren (DE); Günter Baur, Süssen (DE); Michael Basting, Süssen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 77 days.

(21) Appl. No.: 14/718,728

(22) Filed: May 21, 2015

(65) Prior Publication Data

US 2015/0337463 A1 Nov. 26, 2015

(30) Foreign Application Priority Data

May 21, 2014 (DE) ..... 10 2014 107 181.6

(51) Int. Cl.
*D01H 4/40* (2006.01)
*D01H 7/90* (2006.01)

(52) U.S. Cl.
CPC ..... *D01H 4/40* (2013.01); *D01H 7/90* (2013.01)

(58) Field of Classification Search
CPC .. D01H 4/08; D01H 4/40; D01H 7/90; D01H 7/92; D01H 7/926
See application file for complete search history.

(56) References Cited

U.S. PATENT DOCUMENTS

| | | | | |
|---|---|---|---|---|
| 3,875,731 A * | 4/1975 | Khomyakov | B65H 57/12 57/414 |
| 4,499,719 A | 2/1985 | Faessler | |
| 4,516,397 A | 5/1985 | Raasch et al. | |
| 4,665,687 A * | 5/1987 | Ott | D01H 4/40 57/414 |
| 4,702,069 A * | 10/1987 | Maximov | D01H 4/40 57/414 |
| 4,773,211 A | 9/1988 | Stahlecker et al. | |
| 4,843,812 A * | 7/1989 | Raasch | D01H 4/40 57/334 |

(Continued)

FOREIGN PATENT DOCUMENTS

| | | |
|---|---|---|
| DE | 40 39 755 | 6/1992 |
| DE | 10 2012 108 550 | 8/2013 |

OTHER PUBLICATIONS

German Patent Office Search Report, Feb. 11, 2015.

*Primary Examiner* — Shaun R Hurley
(74) *Attorney, Agent, or Firm* — Dority & Manning, P.A.

(57) ABSTRACT

A false twist device for an open-end spinning device to introduce a false twist in a yarn has a largely tubular carcass and several false twist edges arranged behind one another in the yarn draw-off direction and inclined by an angle in the carcass with regard to the yarn draw-off direction. The false twist edges protrude in such a way into the interior of the tubular carcass that the yarn experiences a deflection on each one of the false twist edges. The several false twist edges are arranged offset in such a way in the carcass in circumferential direction that the yarn simultaneously experiences a spatial deflection compared to its regular yarn draw-off direction through the successive deflections on the several false twist edges.

15 Claims, 3 Drawing Sheets

(56) References Cited

U.S. PATENT DOCUMENTS

| | | | | | |
|---|---|---|---|---|---|
| 4,854,119 | A * | 8/1989 | Stahlecker | D01H 4/40 | 57/406 |
| 4,932,202 | A * | 6/1990 | Landwehrkamp | D01H 4/40 | 57/414 |
| 5,044,151 | A * | 9/1991 | Pohn | D01H 4/40 | 57/417 |
| 5,265,406 | A * | 11/1993 | Hofmann | D01H 4/40 | 57/417 |
| 5,321,943 | A * | 6/1994 | Schmid | D01H 4/40 | 57/417 |
| 5,423,177 | A * | 6/1995 | Raasch | D01H 4/40 | 57/417 |
| 6,035,625 | A * | 3/2000 | Schlomer | D01H 4/40 | 57/352 |
| 6,347,506 | B1 * | 2/2002 | Backmeister | D01H 4/40 | 57/417 |
| 7,051,508 | B2 * | 5/2006 | Stahlecker | D01H 4/40 | 57/404 |
| 2005/0011178 | A1 * | 1/2005 | Weide | D01H 4/40 | 57/417 |
| 2005/0229580 | A1 * | 10/2005 | Baur | D01H 4/40 | 57/417 |

* cited by examiner

FALSE TWIST DEVICE FOR AN OPEN-END SPINNING DEVICE

FIELD OF THE INVENTION

The present device refers to a false twist device for an open-end spinning device to introduce a false twist in a yarn produced in an open-end spinning device. The false twist device has a largely cylindrical carcass and several false twist edges arranged behind one another in the carcass in the yarn draw-off direction, inclined around an angle with regard to the yarn draw-off direction. Furthermore, the invention refers to an open-end spinning device with such a false twist device and a method for introducing a false twist in a yarn produced in an open-end spinning device of a rotor spinning machine.

BACKGROUND

When yarn is produced in an open-end spinning device of a rotor spinning machine, the spinning fibers are opened into individual fibers and fed to the spinning rotor and pulled off as spun, twisted yarn through a yarn draw-off nozzle centrally arranged in the spinning rotor. In the process, the rotation of the spinning rotor causes the individual fibers to be incorporated in the end of the already produced yarn, which extends as a rotating yarn leg between the rotor groove and the yarn draw-off nozzle, and a twist is imparted to the yarn. Here, the spinning stability of the open-end spinning device depends essentially from the twist of the revolving yarn leg extending between the yarn draw-off nozzle and the rotor groove. In this case, a yarn twist that is too low will always have a negative impact on spinning stability. Therefore, various open-end spinning devices have been known in the state of the art with which twists as false twist can be pushed back towards the spinning rotor against the yarn's draw-off direction. This makes it possible to increase the real twist in the yarn section between the yarn draw-off nozzle and the rotor groove.

DE 40 39 755 A1 shows such a yarn draw-off device of a rotor spinning machine, in which a yarn deflection point is arranged downstream from the yarn draw-off nozzle, and the yarn is drawn off in this deflection point through false twist edges lying obliquely to the yarn path. At the same time, the false twist edges can have a largely circular cross-section and be executed web-like or triangularly. This can generate a false twist that becomes larger as the profile of the false twist becomes more sharp-edged. However, if the false twist becomes too sharp-edged, it can damage the yarn surface, so that a compromise must always be selected in practice between introducing a false twist that is as large as possible but nonetheless able to prevent yarn damage.

Apart from the execution of the profile of the false twist edges, the generation of the false twist is additionally influenced by the yarn's wrapping angle with regard to the false twist edge. Therefore, DE 87 02 807 U1 suggests arranging another deflection or false twist edge downstream from the yarn draw-off nozzle opposite the first false twist edge, to deflect the yarn in a direction other than the one of the previous deflection. As a result of this, the yarn's wrapping angle at the first false twist edge can be increased, thus preventing the yarn from being raised from the false twist edge. As a result of this, the effect of the false twist edge can be improved. Incidentally, however, the introduction of the false twist can also be influenced here by the sharp edge quality of the false twist edges, so that the possibilities of introducing a false twist without damaging the yarn are limited here as well.

SUMMARY

A task of the present invention is therefore to generate an improved false twist with only slight yarn strain. Additional objects and advantages of the invention will be set forth in part in the following description, or may be obvious from the description, or may be learned through practice of the invention.

The task is solved by the characteristics of the invention described and claimed herein.

A false twist device for an open-end spinning device for introducing a false twist in a yarn produced in the open-end spinning device has a largely tubular carcass and several false twist edges arranged behind one another in a yarn draw-off direction and inclined around an angle in the carcass with regard to the yarn draw-off direction. Several false twist edges are provided so they can protrude in such a way into the interior of the tubular carcass that the yarn on each one of the false twist edges experiences a deflection. At the same time, the false twist edges have been offset in the circumferential direction in the carcass in such a way that the yarn experiences additionally a spatial, particularly helical deflection too with respect to its regular yarn draw-off direction by the successive deflections on the several false twist edges. Here, the false twist device is arranged in an open-end spinning device of a rotor spinning machine in yarn draw-off direction downstream from a yarn draw-off nozzle in order to push back twists as false twist in the direction of the spinning rotor.

In a method to introduce a false twist in a yarn produced in an open-end spinning device of a rotor spinning machine, the yarn is drawn off through a yarn draw-off nozzle and pulled over false twist edges in a false twist device arranged downstream from the yarn draw-off nozzle. As a result of this, the yarn is imparted a false twist. The intention is to expose the yarn to a spatial, particularly helical, deflection with regard to its regular yarn draw-off direction by the false twist edges, in which case an additional false twist is imparted to the yarn.

It is therefore suggested that the false twist is generated in the method or false twist device through false twist edges, as in known false twist devices. The arrangement of several false twist edges behind one another deflects the yarn in each case in defined, successive points of the yarn path of the false twist device. At the same time, however, torsion is imparted to the yarn by the deflection in the points defined by the false twist, since it experiences a twist or corresponding spatial deflection owing to the false twist edges being displaced in circumferential direction by the succession of the deflections.

Owing to the fact that two different mechanisms impart a false twist to the yarn, a significantly higher false twist can be generated than in a conventional false twist device, thus increasing spinning stability. Because a high false twist is introduced, it is therefore also possible to spin with a lower yarn twist, with which otherwise no sufficient spinning stability could be achieved. Due to the improved creation of a false twist, it is furthermore also possible to execute the false twist edges with less sharp edges. As a result of that, the false twist can be introduced to the yarn in an especially gentle way.

According to an advantageous design of the false twist device, the false twist edges have a height that is greater than the one-half of the internal diameter of the carcass. As a result of this, both the wrapping angle can be increased on the individual false twist edges (thus allowing a higher false twist to be introduced) and a higher spatial deflection of the yarn can be achieved as well, which provides an additional false twist. It is thus advantageous for the false twist edges to have the same height. However, a spatial deflection of the yarn can also be achieved if the false twist edges have different heights, i.e. false twist edges are used that protrude differently into the interior of the false twist device.

According to an especially advantageous embodiment, the false twist device has at least three false twist edges arranged offset to one another around a uniform offset angle in the circumferential direction. As a result of this, a helical deflection can be favorably generated on the three or more false twist edges, thereby introducing the false twist in the yarn. The uniform introduction of the false twist in the yarn is supported here by the uniform offset angle. If three false twist edges are provided, then the false twist edges are preferably arranged in each case offset to one another by an offset angle of 120°.

Basically, it is just as possible, however, to arrange false twist edges with different offset angles with respect to one another, in which case the false twist edges can have both the same and a different height.

Since the yarn deflection is also determined by contiguous thread-guiding organs such as the yarn draw-off nozzle, a small draw-off tube arranged downstream from the false twist device, or another yarn deflection, however, the desired spatial deflection of the yarn in the false twist device can also be attained with two false twist edges.

According to an advantageous further development of the invention, the false twist edges are arranged here in slanted way and have an inclination of 40° to 60° with respect to the yarn draw-off direction. Such an inclination angle is capable of generating an especially high false twist.

According to another advantageous embodiment, the false twist edges are executed as webs that can be inserted into the carcass of the false twist device. In this case, the webs can be glued or clipped on in a cylindrical or semi-cylindrical carcass or fastened in another way.

It is at the same time advantageous if the entire false twist device is executed with the tubular carcass and the false twist edges as an insert that can be inserted into the open-end spinning device and preferably detached again from the open-end spinning device. It can, in turn, be glued to a corresponding housing or draw-off duct of the open-end spinning device or inserted and fastened in another way.

It is especially advantageous here if the insert has several, preferably cylindrical or semi-cylindrical sections arranged one behind the other in the yarn draw-off direction. In this case, a false twist edge is arranged preferably in each one of the sections. Such a semi-cylindrical section of the insert with a false twist edge can be manufactured economically as molded part, since its shape can be easily changed owing to its shaping. It is also advantageous here that the various sections can also be manufactured as identical parts, which are then merely twisted together around the offset angle and combined to form the insert.

It is furthermore advantageous if the sections have at least one positioning element that can position them in circumferential direction around the offset angle with regard to a contiguous section. If the positioning elements are positioned accordingly, the sections can nonetheless be executed advantageously as equal parts.

It is additionally advantageous if the insert or its sections are made of ceramic, metal or plastic. To manufacture the insert or its sections, it is furthermore advantageous if the insert or its sections are made as injection molding parts because this allows a more economical production of the false twist device.

During the execution of the false twist device from several sections, it is especially advantageous if the false twist device has a likewise cylindrical or tubular housing surrounding the insert. By having the individual sections in a tubular housing, they can be arranged so they can be replaced very easily when they wear out.

It is furthermore particularly advantageous if the yarn draw-off nozzle and the false twist device have a common, preferably detachable, housing arranged in the open-end spinning device. In this case, the false twist device and the yarn draw-off nozzle are executed as one modular unit. Here, an axial fixation of the insert or its sections can also be achieved with the yarn draw-off nozzle and/or the housing. A separate axial fastening of the sections with one another or of the sections in the housing can be dispensed with as a result of this. The false twist device is here arranged in yarn draw-off direction, preferably directly behind the yarn draw-off nozzle.

It is just as possible, however, for the false twist device to have a separate housing or be arranged separately from the yarn draw-off nozzle in a draw-off duct of the open-end spinning device.

In an open-end spinning device it is furthermore advantageous if a small draw-off tube and/or an additional twist element is/are installed downstream from the false twist device. The additional deflection in the twist element installed downstream ensures that the yarn gets a sufficient wrapping angle on each one of the successive false twist edges, thereby preventing the lifting of the yarn from the false twist edge.

BRIEF DESCRIPTION OF THE DRAWINGS

Additional advantages of the invention are described by means of the embodiments shown below, which show.

DETAILED DESCRIPTION

Figure 1:
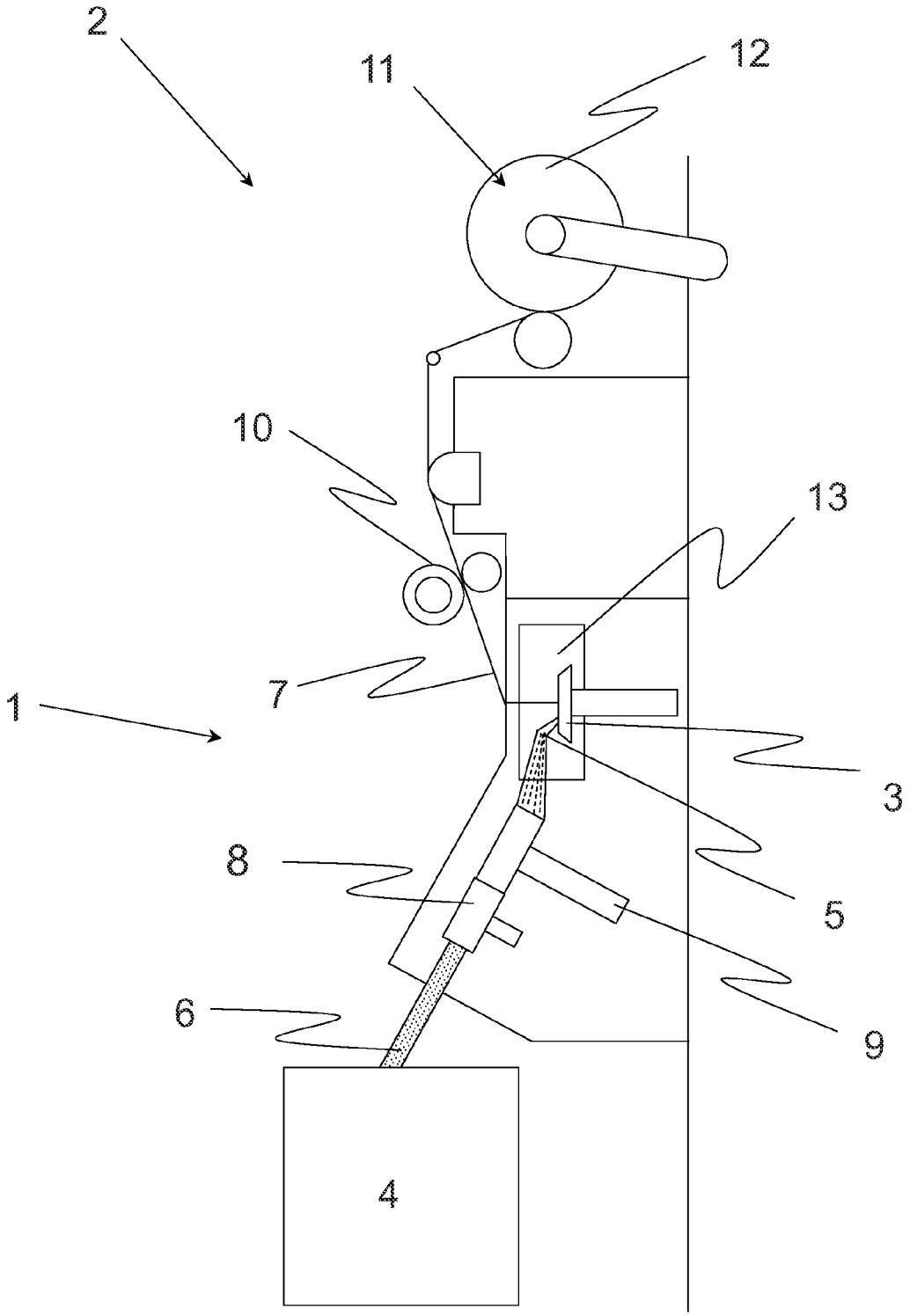
FIG. 1 an overview of a working position of a rotor spinning machine in a schematic lateral view, FIG. 2 a schematic cross-sectional view of an open-end spinning device showing a yarn draw-off nozzle and a false twist device, FIG. 3 a schematic diagram of a spatial deflection of the yarn on false twist edges arranged offset to one another in circumferential direction, FIG. 4 a view of a false twist device executed as insert with several sections, FIG. 5 a false twist device made up of several sections with a yarn draw-off nozzle in a joint housing, and FIG. 6 a detailed view of an individual section of a false twist device executed as an insert.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic lateral view of an open-end spinning device 1 of a rotor spinning machine 2. The rotor spinning machine 2 includes here many working positions arranged beside one another in longitudinal direction of the spinning machine 2. Here, each working position includes typically a feeding device 8, which feeds fiber material 6 to the open-end spinning device 1 through an opening device 9, which opens the fiber material 6 into individual fibers. In this process, the fiber material 6 is stored in storage containers 4 on the rotor spinning machine 2. The fiber material 6 opened into individual fibers is finally fed to the spinning rotor 3 of the open-end spinning device 1 via a fiber feeding duct 5 (see FIG. 2). The yarn 7 produced in the spinning rotor 3 is finally drawn off from the open-end spinning device 1 via a draw-off device 10 and wound up onto a bobbin 12 by means of a winding device 11.

Figure 2:
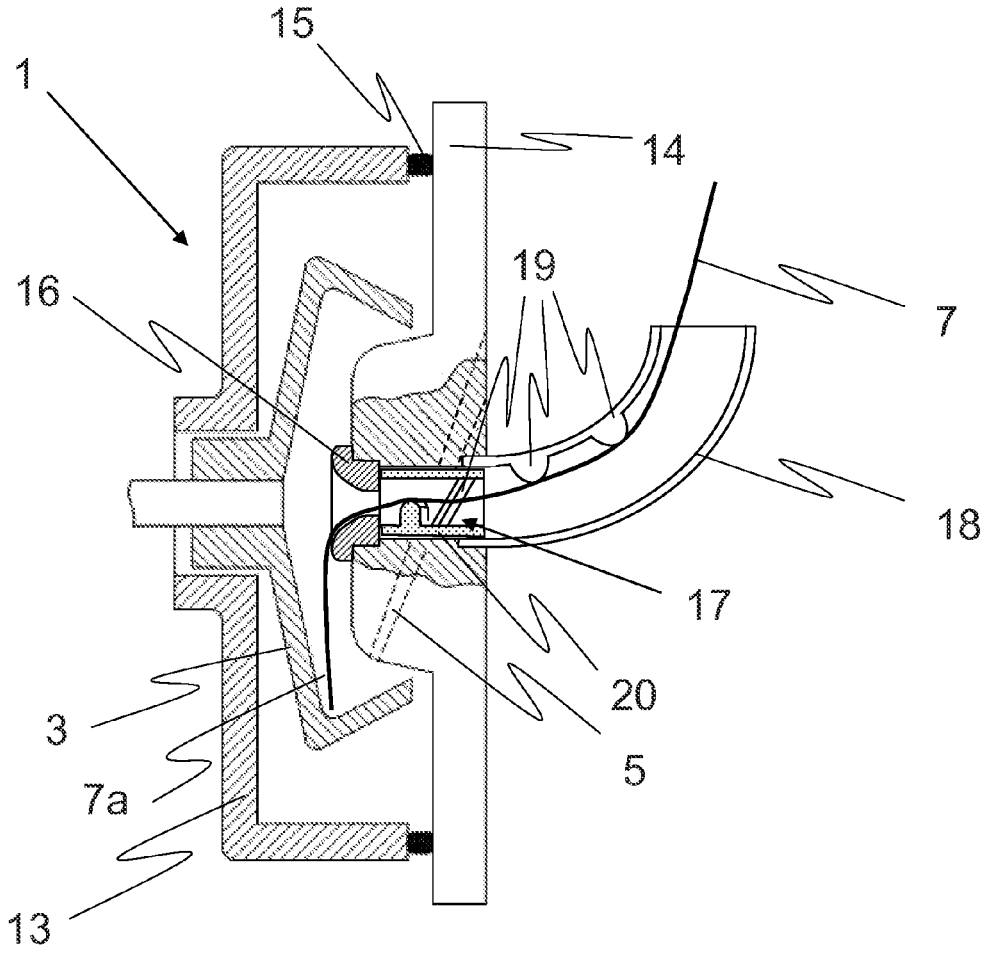

The open-end spinning device 1 is shown schematically in FIG. 2 in a cutaway lateral view. The open-end spinning device 1 encompasses here a spinning rotor 3, whose rotor cup is arranged in a rotor housing 13. The rotor housing 13 is typically impinged with negative spinning pressure and closed by a detachable lid 14. A seal 15 is provided between the rotor housing 13 and the lid 14 to maintain the negative spinning pressure prevalent in the rotor housing 13. Furthermore, the fiber feeding duct 5 (already described in FIG. 1) is arranged in the lid 14. One end of the duct is connected to the opening device 9 and its other end protrudes into the spinning rotor 3 so the fiber material 6 can be fed to the inner wall of the spinning rotor 3.

To produce the yarn, the individual fibers fed into the spinning rotor 3 are transported to the rotor groove of the spinning rotor 3 owing to the centrifugal force. There, they make contact with a rotating yarn leg 7*a* of the already produced yarn 7 and are incorporated into the yarn end 7*a* due to the rotation of the spinning rotor 3. To improve fiber incorporation, it has proven advantageous to increase yarn twisting in the rotating yarn leg 7*a* located between the yarn draw-off nozzle 16 and the rotor groove by means of a false twist device 17. The yarn 7 produced in the spinning rotor 3 is finally drawn off through the draw-off device 10 via a yarn draw-off nozzle 16 arranged in the lid 14 too and through the false twist device 17 arranged downstream from the yarn draw-off nozzle 16. According to the present description, a small draw-off tube 18 having additional false twist edges 19 is furthermore arranged after the false twist device 17. This is not absolutely necessary, however. Likewise, the yarn 7 can be directly fed to the draw-off device 10 after it comes out of the false twist device 17 without another deflection and without passing through another twist element.

In conventional false twist devices 17, the yarn 7 is pulled in the yarn draw-off direction G over several false twist edges 19 arranged in succession. In this process, the flattening out of the yarn cross section on the false twist edges causes the yarn 7 twists to be pushed all the way through the yarn draw-off nozzle 16 back to the rotating yarn leg 7*a* or to the rotor groove.

The present false twist device 17 provides the false twist edges 19 to be arranged not only behind one another in yarn draw-off direction G, but at the same time offset in the circumferential direction in the carcass 20 of the false twist device 17. This makes it possible to achieve a spatial deflection of the yarn 7, which—in addition to the twist displacement by the false twist edges 19—gives the yarn an additional twist that is propagated, in turn, as a false twist into the rotor groove area.

Figure 3:
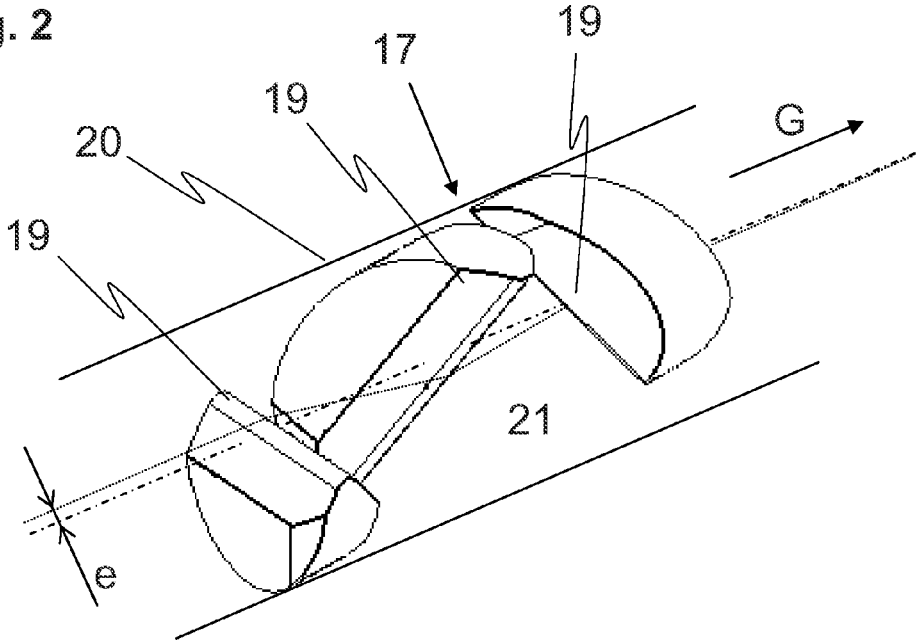

The basic drawing of FIG. 3 shows such a false twist device 17. Here, the regular yarn draw-off direction G is indicated by a dot and dash line in FIG. 3. In the present false twist device 17, the false twist edges 19 are not only arranged offset in the carcass 20 behind one another in yarn draw-off direction G, but at the same time also in circumferential direction of the false twist device 17 or the carcass 20 of the false twist device 17 and protrude into the yarn-guiding interior cross-section or interior 21 of the false twist device 17, so that the yarn 7 experiences a spatial deflection compared to the regular yarn draw-off direction G. The thread path of the deflected yarn 7 is shown here by a dotted line.

In this process, it is evident that on each one of the false twist edges 19, the yarn 7 is deflected from the regular yarn draw-off direction G by an amount e. Through the spiral staircase-like arrangement of the false twist edges 19, the yarn 7 experiences a helicoidal deflection that imparts the yarn 7 an additional torsion momentum. Here, it is particularly advantageous if—as described above—the false twist edges 19 are arranged offset to one another around a uniform offset angle in circumferential direction. Thus, as described above, three of the false twist edges 19 can be twisted in each case by 120° but it is not absolutely necessary to distribute false twist edges 19 on exactly 360° of the circumferential direction. The desired spatial deflection of the yarn 7 can also be achieved with several false twist edges 19 or with fewer false twist edges 19 too, although it is not absolutely necessary to arrange the false twist edges 19 at regular distances from one another with regard to the yarn draw-off direction G or with regular offset angles with regard to the circumferential direction. In this case, the spatial deflection or helical path of the yarn resulting from the arrangement of the false twist edges 19 can be oriented both to the right and to the left with regard to the yarn draw-off direction G. In the case of a z-twist in the yarn, the helical line turns to the right in thread draw-off direction.

Figure 4:
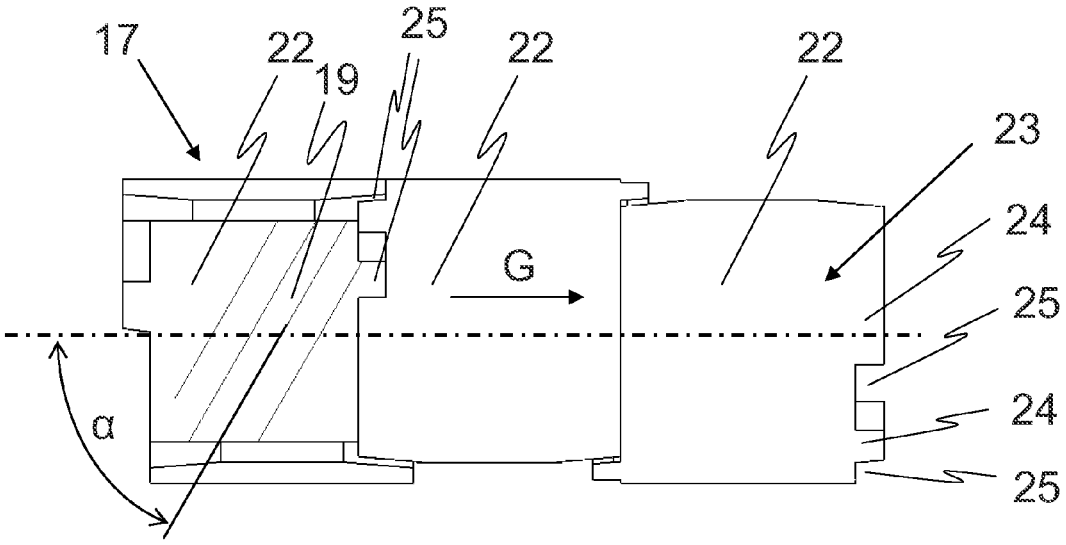

FIG. 4 shows a first embodiment of a false twist device 17 executed as an insert 23 consisting of several sections 22. The false twist device 17 or the insert 23 consists here of three largely semi-cylindrical sections 22, whereby a false twist edge 19 has been arranged in each one of the sections 22. The false twist edges 19 have preferably an angle $\alpha$ of 40° to 60° in the yarn draw-off direction G. This inclination of the false twist edges 19, in turn, allows the further increase of the false twist that can be introduced. The individual sections 22 are now twisted in each case towards one another by an offset angle and in yarn draw-off direction G behind one another and put together to the insert 23. Here, one or several projections 24 are preferably arranged in each one of the sections 22 and they act together, in turn, with the corresponding recesses 25 of contiguous sections 22. Thus, the projections 24 and recesses 25 constitute positioning elements used to position the individual sections 22 together in circumferential direction. As a result of this, the individual sections 22 of the false twist device 17 are joined together form-fittingly in circumferential direction and secured against twisting.

Figure 6:
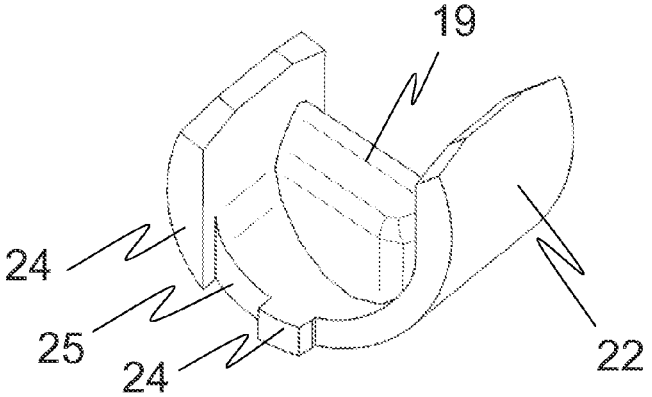

FIG. 6 shows a detailed view of such an individual section 22 with a false twist edge 19. As can be seen in FIG. 6, owing to the shape of a semi-cylindrical shell with the false twist edge 19 arranged therein, such a section 22 can be manufactured economically as an injection molded part, as the shape given to the part allows easy deformation.

Such a false twist device 17 made up of individual sections 22 has preferably a housing 26 surrounding the insert 23 or individual sections 22 of the insert 23. It is also possible here to insert the insert 23 with its surrounding housing 26 into the open-end spinning device. However, it is likewise conceivable to insert the insert 23 or the individual sections 22 of the insert 23 directly into a draw-off duct of the open-end spinning device 1, which can be executed in the lid element 14 (see FIG. 2).

According to another embodiment (see FIG. 5), however, the false twist device 17 and the yarn draw-off nozzle 16 are arranged in one joint housing 26. In this case, the false twist device 17 is thus arranged directly downstream from the yarn draw-off nozzle 16, so that the torsion momentum generated by the false twist device 17 supports directly a false twist already generated by the yarn draw-off nozzle 16. In the process, the individual sections 22 of the insert 23 can be fastened additionally together (e.g. glued to one another). However, if a housing 26 surrounding the individual sections 22 is provided, then this is not absolutely necessary because a fixation of both of the individual sections 22 and of a one-part insert 23 can also be accomplished with the housing and/or the yarn draw-off nozzle 16, on which the insert 23 can find support in yarn draw-off direction G.

Figure 5:
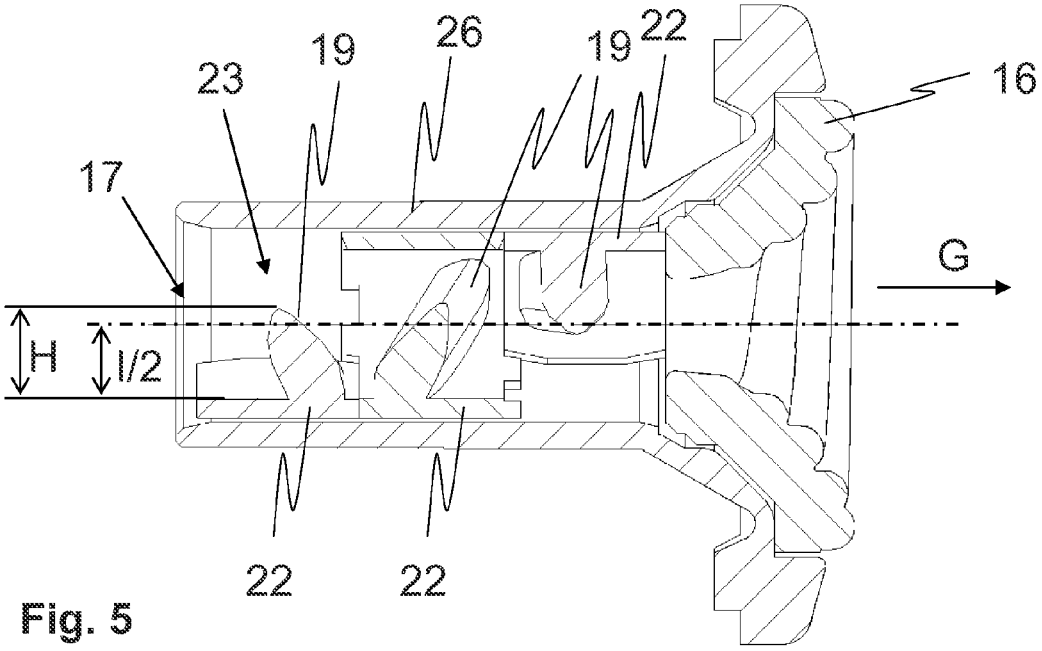

As can be seen in FIG. 5, the false twist edges 19 have a certain height H here, greater than one-half of the interior diameter I of the carcass 20, so that a good spatial deflection of the yarn 7 can be generated as a result of that. Such a structural unit from a yarn draw-off nozzle 16 and a false twist device 17 can easily be removed from the open-end spinning device 1, and the yarn draw-off nozzle 16 and the false twist edges 19 or the insert 23 can be easily replaced.

Deviating from the diagram shown in FIGS. 4-6, however, it is also possible to manufacture the false twist edges 19 as webs and insert the false twist device 17 into the carcass 20, either by gluing or clipping it on, for example.

The invention is not restricted to the embodiments shown. Thus, one-piece inserts 23 can also be especially provided instead of an insert 23 made up of several sections 22. Likewise, the false twist device 17 could have a cylindrical carcass 20, into whose cylindrical area false twist edges 19 executed as webs or pins could be inserted from the side. Moreover, it is not absolutely necessary to arrange the false twist device 17 (as shown in FIGS. 2 and 5, for example), coaxially to the yarn draw-off nozzle 16 and directly downstream from the yarn draw-off nozzle 16. The false twist device 17 can likewise be provided in an angle to the yarn draw-off nozzle 16. Furthermore, regarding the number and arrangement of the false twist edges 19 within the false twist device 17, numerous variations are possible. Thus, for example, even less than three false twist edges 19 can be provided in the false twist device 17, and the false twist device 17 can also have an inlet or outlet area that constitutes an additional yarn deflection. Further variations and combinations also fall under the invention as part of the patent claims.

LIST OF REFERENCE CHARACTERS

1 Open-end spinning device
2 Rotor spinning machine
3 Spinning rotor
4 Storage container
5 Fiber feeding duct
6 Fiber material
7 Yarn
**7*a*** rotating yarn leg
8 Feeding device
9 Opening device
10 Draw-off device
11 Winding device
12 Bobbin
13 Rotor housing
14 Lid of the rotor housing
15 Seal of the rotor housing
16 Yarn draw-off nozzle
17 False twist device
18 Small draw-off tube
19 False twist edge
20 Carcass
21 Interior
22 Section
23 Insert
24 Projection
25 Recesses
26 Housing
α a Inclination angle of the false twist edges
e Deflection of the yarns on the false twist edge
G Yarn draw-off direction
H Height of the false twist edges
I Inner diameter of the carcass

The invention claimed is:

1. A false twist device for an open-end spinning device to introduce a false twist in a yarn produced in the open-end spinning device, the false twist device comprising:

a tubular carcass;

a plurality of false twist edges arranged behind one another in a yarn draw-off direction through the device, each of the false twist edges inclined at an angle (α) in the carcass relative to the yarn draw-off direction;

the plurality of false twist edges configured in an interior of the carcass such that each individual false twist edge imparts a deflection to a yarn drawn through the carcass; and the plurality of false twist edges offset in a circumferential direction in the carcass such that the yarn drawn through the carcass is also simultaneously subjected to a spatial, helical, deflection through the successive deflections on the false twist edges.

2. The false twist device according to claim 1, wherein the false twist edges have a height within the carcass greater than one-half of an inner diameter of the carcass.

3. The false twist device according to claim 1, comprising at least three of the false twist edges.

4. The false twist device according to claim 3, wherein three of the false twist edges are arranged circumferentially offset to one another by a circumferential offset angle 120°.

5. The false twist device according to claim 1, wherein the false twist edges are defined as webs that are inserted into the carcass.

6. The false twist device according to claim 1, wherein the device is configured as a detachable insert that can be inserted in the open-end spinning device.

7. The false twist device according to claim 1, further comprising a plurality of cylindrical or semi-cylindrical sections arranged behind one another in the yarn draw-off direction, wherein one of the false twist edges in provided in each respective one of the sections.

8. The false twist device according to claim 7, wherein each section comprises at least one positioning element that positions the section in a defined circumferential offset angle relative to an adjacent section.

9. The false twist device according to claim 7, wherein the sections are made of ceramic, metal or plastic.

10. The false twist device according to claim 1, wherein the device is configured as a detachable insert that can be inserted in the open-end spinning device, and further comprising a housing that surrounds the insert.

11. An open-end spinning device of a rotor spinning machine, comprising:

a yarn draw-off nozzle;

a false twist device arranged downstream from the yarn draw-off nozzle in a yarn draw-off direction;

the false twist device further comprising:

a tubular carcass;

a plurality of false twist edges arranged behind one another in a yarn draw-off direction through the device, each of the false twist edges inclined at an angle ($\alpha$) in the carcass relative to the yarn draw-off direction;

the plurality of false twist edges configured in an interior of the carcass such that each individual false twist edge imparts a deflection to a yarn drawn through the carcass; and the plurality of false twist edges offset in a circumferential direction in the carcass such that the yarn drawn through the carcass is also simultaneously subjected to a spatial, helical, deflection through the successive deflections on the false twist edges.

12. The open-end spinning device according to claim 11, wherein the false twist device is arranged in the yarn draw-off direction directly behind the yarn draw-off nozzle.

13. The open-end spinning device according to claim 12, the yarn draw-off nozzle and the false twist device have a common, detachable housing arranged in the open-end spinning device.

14. The open-end spinning device according to claim 11, further comprising a draw-off tube arranged downstream from the false twist device, the draw-off tube defining an additional false twist edge for the yarn.

15. A method for introducing a false twist in a yarn generated in an open-end spinning device of a rotor spinning machine, comprising:

drawing the yarn off through a yarn draw-off nozzle;

pulling the yarn through a plurality of false twist edges in a false twist device arranged downstream from the yarn draw-off nozzle, whereby a false twist is imparted to the yarn; and imparting a spatial, helical deflection to the yarn with the false twist edges to provide an additional component of the false twist imparted to the yarn.

* * * * *